US012070096B2

(12) United States Patent
Bidal et al.

(10) Patent No.: US 12,070,096 B2
(45) Date of Patent: Aug. 27, 2024

(54) ARTICLE OF FOOTWEAR WITH MIDSOLE HAVING VARYING HARDNESS

(71) Applicant: Acushnet Company, Fairhaven, MA (US)

(72) Inventors: Jean-Marie Bidal, Bridgewater, MA (US); Robert S. Bento, Raynham, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/360,145

(22) Filed: Jun. 28, 2021

(65) Prior Publication Data

US 2022/0408879 A1 Dec. 29, 2022

(51) Int. Cl.
*A43B 13/14* (2006.01)

(52) U.S. Cl.
CPC ..... *A43B 13/14* (2013.01)

(58) Field of Classification Search
CPC ..... A43B 13/14; A43B 13/146; A43B 13/143; A43B 13/186; A43B 13/189
See application file for complete search history.

(56) References Cited

U.S. PATENT DOCUMENTS 2,897,611 A * 8/1959 Schaller ..... A43B 13/14 36/181
4,236,326 A * 12/1980 Inohara ..... A43B 13/20 36/35 B
4,302,892 A * 12/1981 Adamik ..... A43B 13/14 36/31
4,322,892 A * 4/1982 Inohara ..... A43B 13/20 36/35 B
4,551,930 A * 11/1985 Graham ..... A43B 5/06 36/114
5,014,449 A * 5/1991 Richard ..... A43B 3/0084 36/114
5,799,417 A * 9/1998 Burke ..... A43B 21/26 36/105
5,842,294 A 12/1998 Fabricant
6,416,610 B1 * 7/2002 Matis ..... A43B 13/12 264/273
6,775,930 B2 8/2004 Fuerst
7,647,709 B2 1/2010 Reilly et al.
7,673,400 B2 3/2010 Brown et al.
D618,894 S 7/2010 Taestensen
7,997,013 B2 8/2011 Reilly et al.
8,621,768 B2 1/2014 Robinson, Jr. et al.
D728,910 S 5/2015 Hansen
D742,106 S 11/2015 Taestensen
(Continued)

OTHER PUBLICATIONS

Korean Intellectual Property Office, Notice of Preliminary Rejection for International Patent Application No. KR 10-2022-0076576, Mar. 15, 2024.

*Primary Examiner* — Bao-Thieu L Nguyen
(74) *Attorney, Agent, or Firm* — Williams Mullen; F. Michael Sajovec

(57) ABSTRACT

The article of footwear may include an upper, a heel region having a heel core and a heel perimeter, a forefront region, a medial side, a lateral side, an outsole and a midsole. The midsole may be a dual durometer midsole and include a soft durometer positioned between the heel region and the forefoot region and a firm durometer positioned around the heel perimeter.

20 Claims, 9 Drawing Sheets

(56) References Cited

U.S. PATENT DOCUMENTS

| | | | | |
|---|---|---|---|---|
| 9,775,402 | B2 | 10/2017 | Nonogawa et al. | |
| D804,788 | S | 12/2017 | Bikowski | |
| D828,991 | S | 9/2018 | Herath | |
| 10,299,533 | B2 | 5/2019 | Adair et al. | |
| D841,304 | S | 12/2019 | DeAlmeida | |
| 10,524,542 | B2 * | 1/2020 | Avar | A43B 23/0275 |
| 10,595,585 | B2 | 3/2020 | Bacon et al. | |
| D887,690 | S | 6/2020 | Blimel | |
| 10,716,360 | B2 * | 7/2020 | Cross | A43B 3/0073 |
| 10,786,040 | B2 | 9/2020 | Madore | |
| 10,856,613 | B2 | 12/2020 | Bento et al. | |
| 2009/0178300 | A1 * | 7/2009 | Parker | A43B 13/189 12/146 B |
| 2009/0320330 | A1 * | 12/2009 | Borel | A43B 13/18 36/30 R |
| 2011/0283560 | A1 * | 11/2011 | Portzline | A43B 13/186 36/31 |
| 2015/0342300 | A1 * | 12/2015 | Cin | A43B 13/127 36/103 |
| 2017/0258180 | A1 * | 9/2017 | Cross | A43B 13/02 |
| 2017/0318899 | A1 * | 11/2017 | Hendrix | A43B 7/08 |
| 2017/0325544 | A1 * | 11/2017 | Ngene | A43B 13/181 |
| 2020/0113273 | A1 * | 4/2020 | Aubonnet | A43B 13/143 |
| 2020/0128910 | A1 * | 4/2020 | Chang | A43B 13/14 |
| 2020/0375309 | A1 * | 12/2020 | Langvin | A43B 13/14 |

* cited by examiner

ARTICLE OF FOOTWEAR WITH MIDSOLE HAVING VARYING HARDNESS

FIELD OF THE DISCLOSURE

The disclosure relates generally to the field of footwear. More specifically, the disclosure relates to the field of footwear having an improved midsole construction.

BACKGROUND

The game of golf includes long stretches of walking and short moments of swinging a golf club to hit a golf ball. Consequently, golf shoes have evolved to provide the wearer with good traction on grass, comfort while walking, and a stable platform for hitting the ball. Golf shoes thus typically have a relatively stiff sole with metal spikes or plastic cleats. Some golf shoes also include gels that cushion the impact of so-called "ground reaction forces" on the foot. From Newton's Third Law of Motion, the law of action-reaction, it is known that the ground pushes on the foot in a direction equal and opposite to the direction the foot pushes on the ground; these are known as ground reaction forces.

The midsoles of footwear are known to strongly affect the sensation of cushioning/comfort by redistributing load magnitudes and rates on the bony load-bearing structures and soft tissues of the foot. A single-density foam of a particular Asker C hardness is most commonly used as a midsole to provide a structure that compresses under walking loads. However, since single density foams are of a uniform hardness, a choice must be made between having a harder sole for support or a softer sole for comfort. Thus, current midsoles are unable to simultaneously provide proper support at regions of the foot under high load and/or comfort for areas of the foot under less load.

There remains a need for footwear having improved midsole that provides sufficient rigidity without sacrificing flexibility and comfort. The footwear should provide stability during a golf swing as the golfer's weight shifts while allowing the golfer to walk comfortably between holes.

SUMMARY

The present disclosure provides an article of footwear having a midsole that provides both stability during the swing and comfort and flexibility while walking and standing.

The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

One aspect of the present disclosure is directed to an article of footwear configured to provide stability, comfort and flexibility. The article of footwear may comprise an upper, a heel region having a heel core and a heel perimeter, a forefront region, a medial side, a lateral side, an outsole and a midsole. The medial side may extend from the forefoot region to the heel region. The lateral side may extend from the forefoot region to the heel region and opposite to and generally parallel to the medial side. The midsole may be a dual durometer midsole and include a soft durometer positioned from the heel region to the forefoot region and a firm durometer positioned around the heel perimeter.

These and other aspects will become apparent to those skilled in the art after a reading of the following description when considered with the drawings.

BRIEF DESCRIPTION OF THE DRAWINGS

Illustrative embodiments of the present disclosure are described in detail below with reference to the attached drawing figures and wherein.

DETAILED DESCRIPTION

Figure 1:
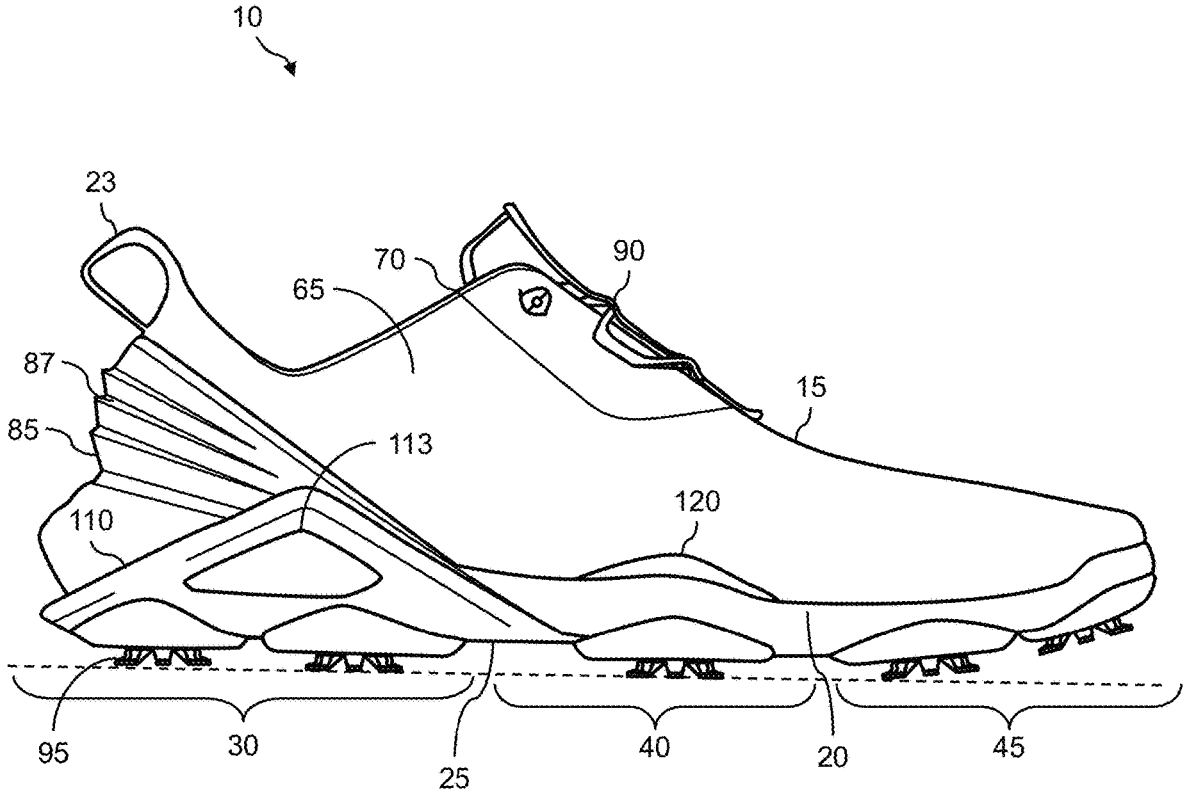
FIG. 1 is a side view of an article of footwear according to an embodiment of the disclosure.

Several embodiments will be described more fully in reference to the accompanying figures. However, this disclosure should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The terminology used herein is for the purposed of describing particular embodiments only and is not intended to be limiting of the invention. As used herein, the singular forms "a," "and," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," "directly coupled" or "directly connected" to another element, there are no intervening elements present.

All patents, patent applications and publications referred to herein are incorporated by reference in their entirety. In case of a conflict in terminology, the present specification is controlling.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Referring now to FIG. 1, an article of footwear 10 is provided according to one embodiment. The article of footwear 10 may include in some embodiments, an upper 15, a midsole 20 joined to the upper 15 and an outsole 25 joined to the midsole 20. The article of footwear may also include a ghille strip 23.

The article of footwear 10 may further include a heel region 30, a midfoot region 40, and a forefoot region 45. The heel region 30 may generally correspond with the rear potions of a foot, namely, the area surrounding and below the Achilles tendon, the posterior of the heel, and the talus and calcaneus bones. A midfoot region 40 may generally correspond with a middle of the foot, namely, the arch and the navicular, cuboid, and cuneiform bones. A forefoot region 45 may generally correspond with a front of a foot, namely, the toes and metatarsal, phalange, and sesamoid bones. It is understood that the heel region 30, midfoot region 40, and forefoot region 45 are intended to represent general areas of footwear and not demarcate precise areas.

In some embodiments, the upper 15 may have an interior surface 60 (see, FIG. 2) and an exterior surface 65. The interior surface 60 may partially define an area configured to receive a person's foot. The upper 15 may be configured to extend over a person's foot, along the medial and lateral sides of the foot, and around a forefoot region and a heel region of the foot. The area configured to receive a person's foot may be accessed from an ankle opening defined by a collar 70.

The upper 15 may be constructed from any appropriate material now known or later developed, including, but not limited to, leather, synthetic leather, polyurethane synthetic, polyvinyl chloride synthetic, hot melt synthetics (thermoplastic polymer laminated to another substrate), suede, fabric, canvas, weaves, knits, man-made polymer fibers, nylon, polyester, or cotton. The upper 15 may be elastic. Alternatively, at least a portion of the upper 15 may be elastic. In other embodiments, the upper 15 may be inelastic. The upper 15 may include at least a portion that is inflexible and may be rigid or semi-rigid.

The upper 15 may further include an external heel counter 85 in the heel region 30. The heel counter 85 may reinforce the upper 15 and reduce or restrict movement of a person's heel. The heel counter 85 may be formed from a hard thermoplastic polymer such as thermoplastic polyurethane ("TPU"). The external heel counter 85 may wrap around the heel region 30 and extend forward along both the lateral side and the medial side. The heel counter 85 may also include ridges 87 or the like to provide stiffness while lessening the overall weight.

In some embodiments, the lace 90 may be above the upper 15 and configured to interact with the outer surface of the upper 15. The lace 90 may be entirely or partially visible. The footwear may include one or more closure systems for securing a user's foot, the selection of which is within the skill of one in the art. Examples of closure systems may include laces, a lace tightening system as described in U.S. Pat. No. 10,070,695 and incorporated herein by reference in its entirety, and a closure system as described in U.S. Ser. No. 17/355,390 filed on Jun. 23, 2021 and incorporated herein by reference in its entirety. It will be appreciated that any suitable lacing or closure system may be used for securing the wearer's foot in the upper 15 of footwear 10. In some embodiments, the article of footwear 10 may have a medial side 50 that extends from a forefoot region 40 to a heel region 30 and a lateral side 55 that extends from a forefoot region 40 to a heel region 30. The lateral side and the medial side may be opposite one another. In some embodiments, the lateral side 55 and medial side 50 may be generally parallel to one another. The lateral side 55 may generally correspond to an outside area of a foot and a surface that faces away from a person's other foot. The medial side 50 may generally correspond with an inside area of a foot and a surface that faces toward a person's other foot.

In some embodiments, the outsole may include traction elements 95. The traction elements 95 may be made of any suitable material such as rubber or plastics and combinations thereof. Thermoplastics such as nylons, polyesters, polyolefins, and polyurethanes may be used. Suitable rubber materials that may be used include, but are not limited to, polybutadiene, polyisoprene, ethylene-propylene rubber ("EPR"), ethylene-propylene-diene ("EPDM") rubber, styrene-butadiene rubber, styrenic block copolymer rubbers, butyl rubber, nitrile rubber, and blends of two or more thereof.

Figure 2:
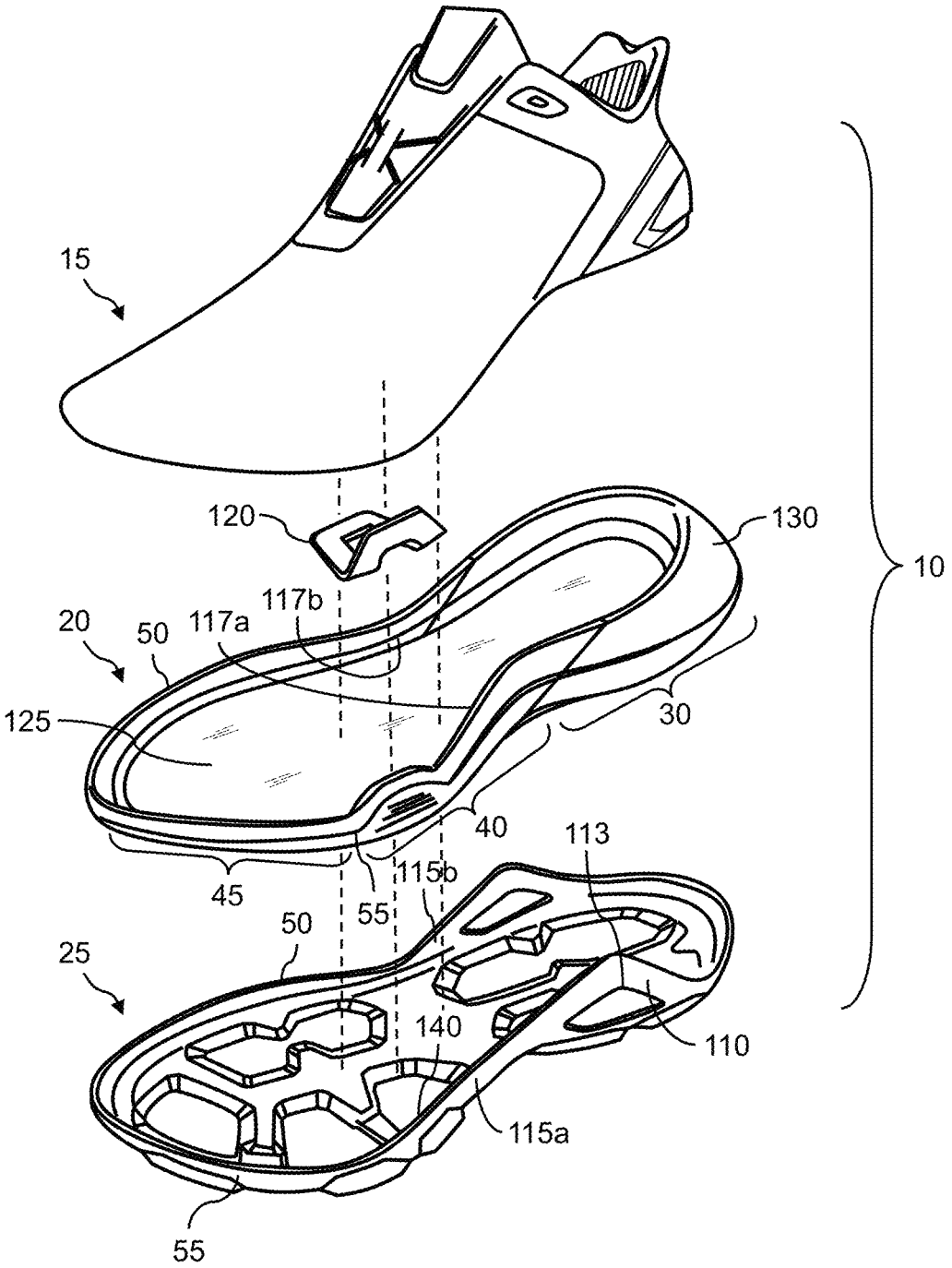
FIG. 2 is an exploded view of an article of footwear including a midsole and placement of a stability insert according to an embodiment of the disclosure.
Figure 3:
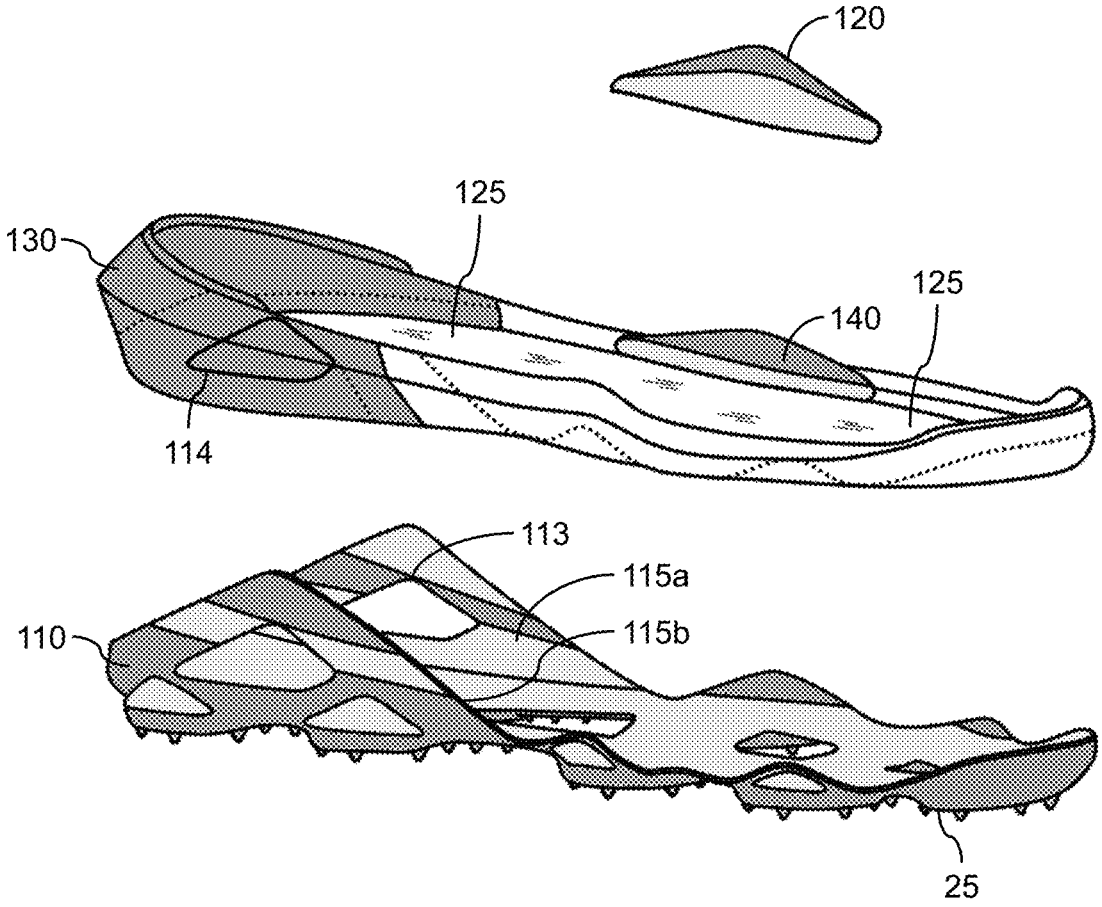
FIG. 3 is an exploded view of a midsole, an outsole and a stability insert according to an embodiment of the disclosure.

Referring to FIGS. 2 and 3, various embodiments of the midsole 20 and the outsole 25 are illustrated. A support frame 110 may be molded into or be part of the outsole. In various embodiments, the support frame 110 may be provided as a solid predetermined shape/geometry or may be provided as a predetermined shape/geometry with openings. In one embodiment, the support frame 110 may extend from the heel region 30 to the midfoot region 40. As shown in FIGS. 2 and 3, a portion of the support frame 110 may be in the predetermined shape/geometry of an A-frame 113. The selection of other shapes/geometries will be within the skill of one in the art and the specific shape/geometry may be selected for providing support, aesthetics, or in a preferred embodiment both. As shown in FIG. 3, the firm durometer portion 130 may include a recess 114 that is shaped like the top portion of the A-frame to position the support frame 110 with the firm durometer portion 130. The support frame 110 may also have a lateral leg 115*a* and a medial leg 115*b*. The lateral/medial legs 115*a*, 115*b* may extend from the firm durometer portion 130 and mate with a corresponding lateral/medial recess 117*a*, 117*b* of the midsole 20.

A stability insert 120 may be in midfoot region 40 on a lateral side 55. As shown in FIG. 2, the midsole 20 may include a stability insert recess 140 for receiving the stability insert 120. The stability insert 120 may be molded from ethylene-vinyl acetate ("EVA") copolymer, polyurethanes and blends thereof. The stability insert 120 may be a harder material to provide stability by reducing sidewall movement of the article of footwear during a golf swing.

Figure 4:
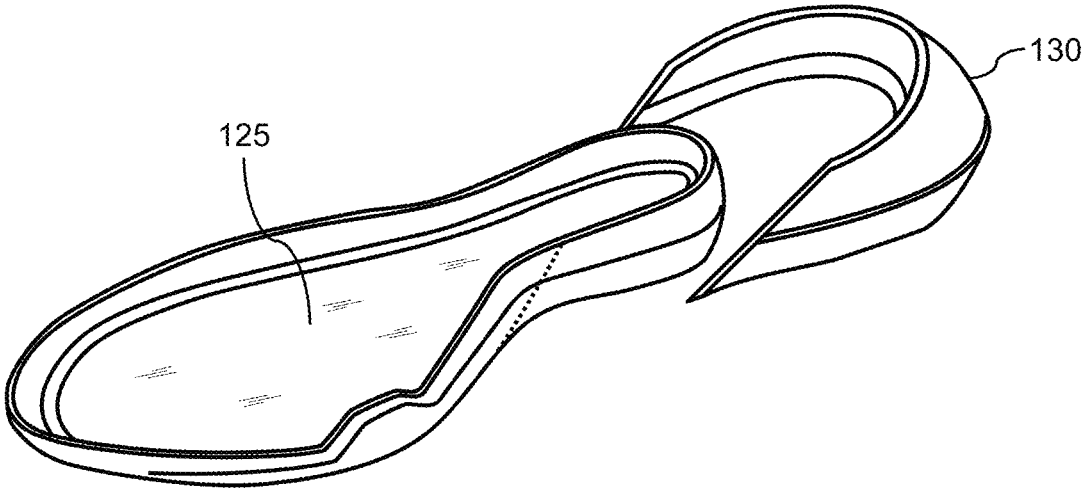
FIG. 4 is a perspective view of a midsole illustrating placement of a firm durometer portion according to an embodiment of the disclosure.

As shown in FIG. 4, the midsole 20 may include a soft durometer portion 125 positioned from the heel region 30 to the forefoot region 45 of the midsole 20. The dual durometer midsole 20 further includes a firm durometer portion 130 positioned around the heel perimeter. In one embodiment, the preferred shape of the firm durometer portion is a U-shape or horseshoe shape to wrap around the heel perimeter. The soft durometer portion 125 may be formed from ethylene-vinyl acetate ("EVA") copolymer. The soft durometer portion 125 may have a Shore C hardness between about 50 and 85, and preferably between about 60 and 65. The firm durometer portion 130 may also be formed from ethylene-vinyl acetate ("EVA") copolymer, polyurethanes and the like and may be injection molded. In one embodiment, the firm durometer portion 130 and the stability insert may be of different materials, may be of the same materials, or may be molded together. The firm durometer portion may have a Shore C hardness between about 60 to 95, preferably between about 70 and 75.

Figure 5:
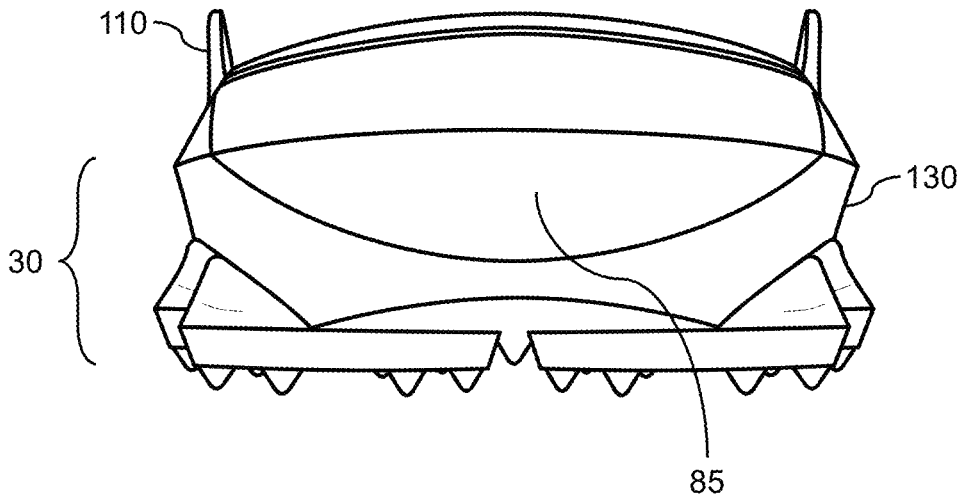
FIG. 5 is a rear elevation view of a midsole of an article of footwear.
Figure 6:
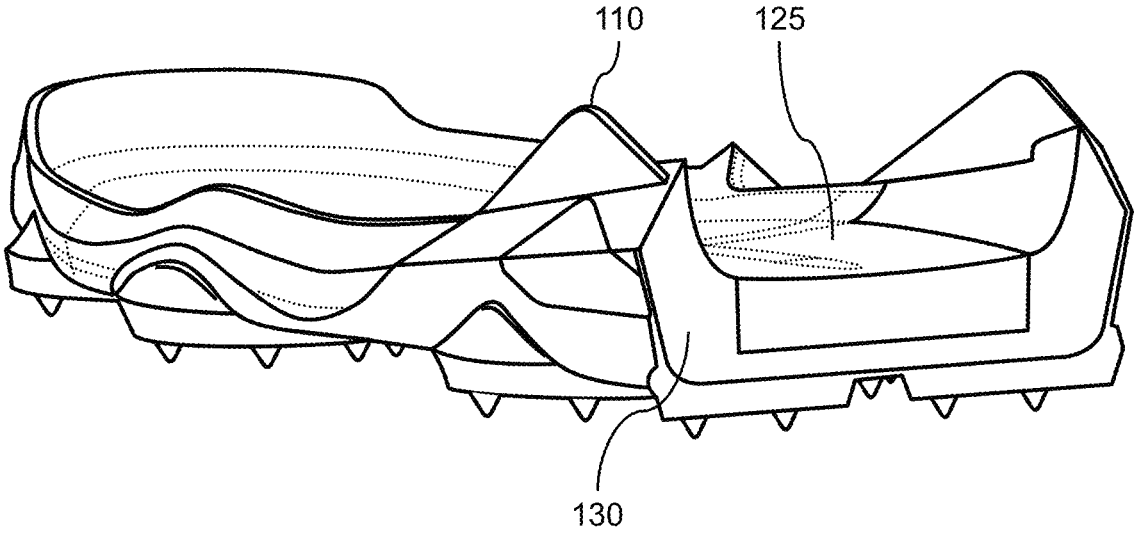
FIG. 6 is a cutaway view of the midsole of FIG. 5 according to an embodiment of the disclosure.

Referring to FIGS. 5 and 6, embodiments of the support frame 110 and firm durometer portion 130 are shown. The firm durometer portion 130 which may be horseshoe-shaped or u-shaped overlaps the external heel counter 85 of the heel region 30 and may be partially under the heal counter 85 namely the heel counter 85 is molded above the firm durometer portion 130. The firm durometer portion 130 may be in contact with the support frame 110. In one embodiment the support frame 110 may have a geometry with sloped or slanted sidewalls as contrasted to straight sidewalls. The firm durometer portion may also be in contact with the soft durometer portion 125.

Figure 7:
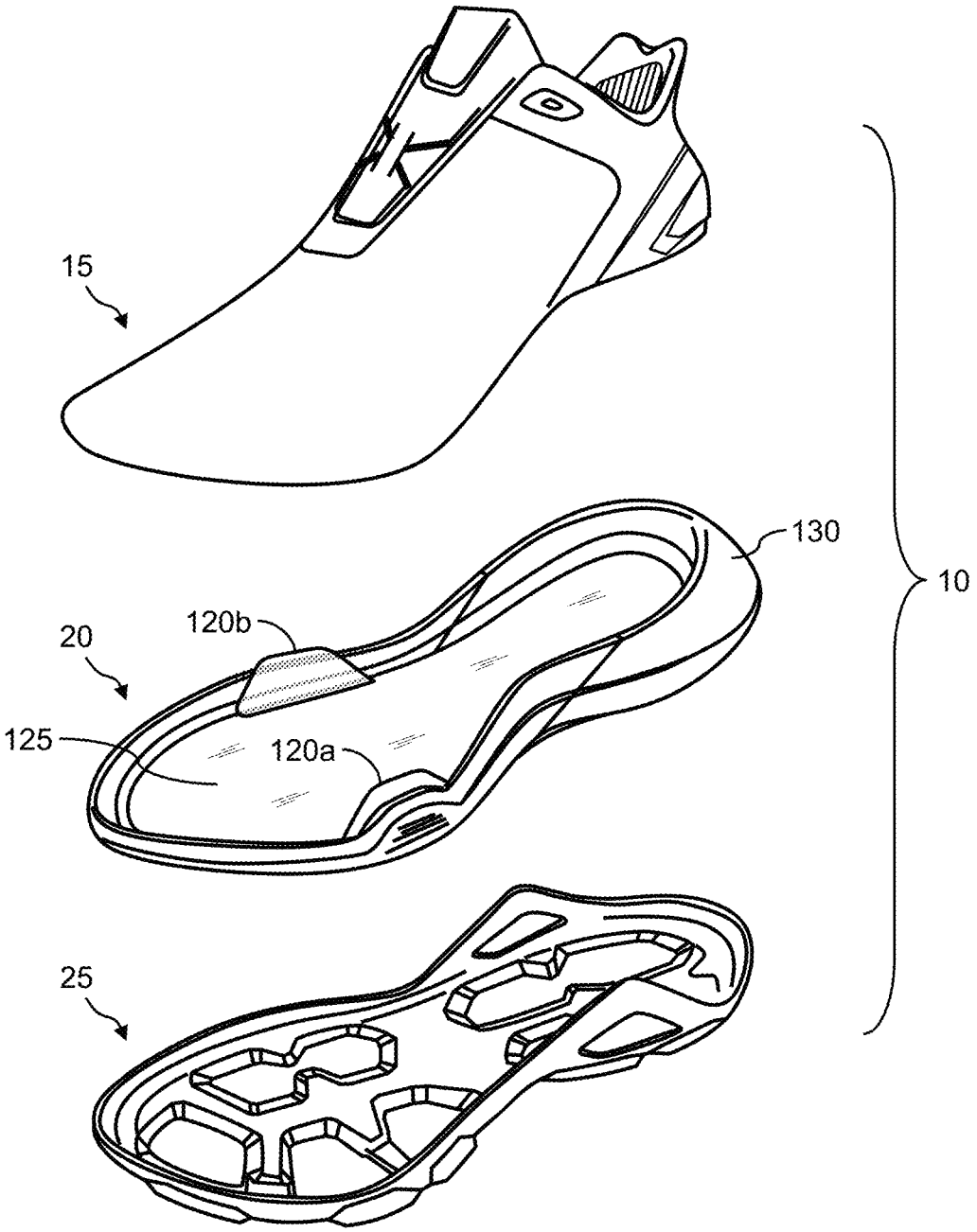
FIG. 7 is an exploded view of an article of footwear including a midsole and a placement of two stability inserts according to an embodiment of the disclosure.
Figure 8:
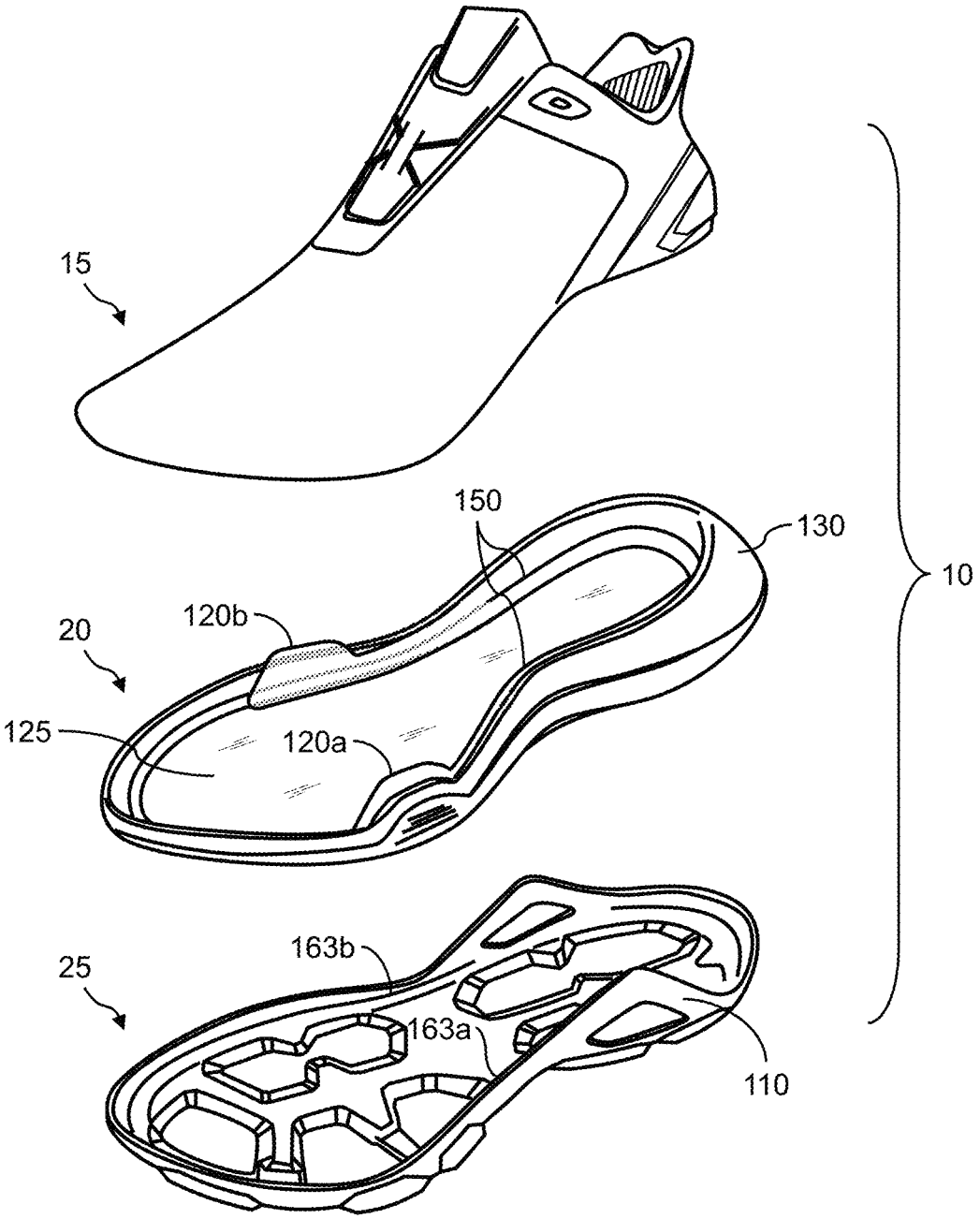
FIG. 8 is an exploded view of an article of footwear including a midsole and a firm durometer portion and stability insert molded together in an embodiment of the disclosure, and is an alternative embodiment to that shown in FIG. 7; and, FIG. 9 is an exploded view of an article of footwear and is an alternative embodiment to that shown in FIG. 7 and FIG. 8.
Figure 9:
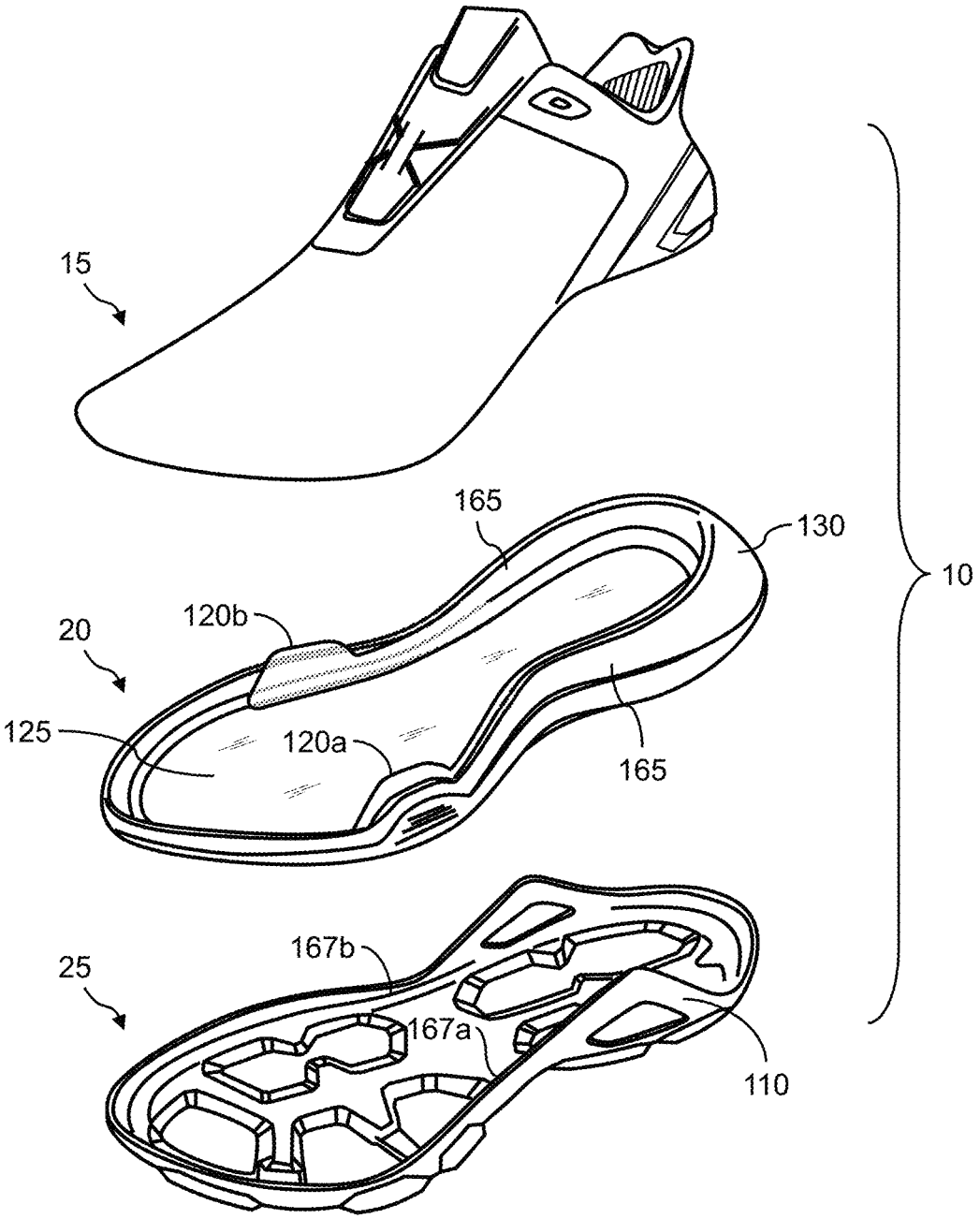

Referring now to FIGS. 7-9, several embodiments of the present invention are, and show alternate embodiments of the orientation of the stability insert 120 and the firm durometer portion 130. In FIG. 7, an embodiment is shown in which there may be two stability inserts, namely a lateral stability insert 120*a* and a medial stability insert 120*b* and the inserts, 120*a*, 120*b* may be separate from the firm durometer portion 130.

In FIG. 8, the lateral and medial stability inserts 120*a*, 120*b* may be connected to, or molded together with the firm durometer portion 130 by an internal bridge section 150. The internal bridge section 150 may be positioned in corresponding outsole internal lateral and medial portions 163*a*, 163*b* of the outsole 20.

In FIG. 9, the lateral and medial stability inserts 120*a*, 120*b* may be connected to, or molded together, with the firm durometer portion 130 by an external bridge section 165. The external bridge section 165 may be positioned in a corresponding insole external lateral and medial portions 167*a*, 167*b*. It is recognized that FIG. 8 and FIG. 9 illustrate embodiments in which there are both lateral and medial stability inserts 120*a*, 120*b*. Alternatively, embodiments are contemplated in which there is only a lateral stability insert connected to, or molded together, with the firm durometer portion.

Components not shown, are possible without departing from the spirit and scope of the present disclosure. Embodiments of the present disclosure have been described with the intent to illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims.

The invention claimed is:

1. An article of footwear comprising:

an upper;

a heel region;

an external heel counter positioned around the heel region;

a forefoot region;

a midfoot region;

a medial side extending from the forefoot region to the heel region;

a lateral side extending from the forefoot region to the heel region and opposite to and generally parallel to the medial side;

a dual durometer midsole comprising (i) a soft durometer portion positioned from the heel region to the forefoot region and (ii) a firm durometer portion positioned in the heel region under the external heel counter;

an outsole, wherein a portion of the outsole forms an A-shaped support frame extending over the external heel counter, wherein a top portion of the A-shaped support frame is positioned within a recess in the firm durometer portion of the midsole, the A-shaped support frame comprising a set of lateral or medial legs, wherein the set of lateral or medial legs is configured to extend from the firm durometer portion of the midsole and mate with a corresponding lateral and medial recess in the soft durometer portion of the midsole, wherein the set of lateral or medial legs includes a first leg extending to the heel region and a second leg extending to the midfoot region, wherein the first leg and second leg are disposed at an angle to form an opening in the A-shaped support frame, wherein the opening is positioned below the external heel counter; and a stability insert positioned at the midfoot region at a lateral side, a medial side, or both the lateral and medial sides.

2. The article of footwear of claim 1, wherein the soft durometer portion, the firm durometer portion, the A-shaped support frame, and the stability insert comprise a thermoplastic material selected from the group consisting of ethylene-vinyl acetate, polyurethane, and blends thereof.

3. The article of footwear of claim 1, wherein the soft durometer portion has a Shore C hardness between about 50 to 85, and wherein the firm durometer portion has a Shore C hardness between about 60 and 95.

4. The article of footwear of claim 1, wherein the external heel counter further includes ridges.

5. The article of footwear of claim 1, wherein the external heel counter is positioned above the firm durometer portion.

6. The article of footwear of claim 1, wherein the stability insert is configured to reduce sidewall movement during a golf swing.

7. The article of footwear of claim 1, wherein the firm durometer portion of the dual durometer midsole is U-shaped or horseshoe-shaped.

8. The article of footwear of claim 1, wherein the stability insert is connected to at least one of the soft durometer portion and the firm durometer portion.

9. The article of footwear of claim 1, wherein the stability insert comprises a lateral stability insert and a medial stability insert molded together with the firm durometer portion.

10. The article of footwear of claim 9, further comprising an internal or external bridge section connecting the lateral stability insert, the medial stability insert, and the firm durometer portion.

11. The article of footwear of claim 1, wherein the A-shaped support frame is (i) molded to the outsole or (ii) part of the outsole.

12. The article of footwear of claim 1, wherein the A-shaped support frame is configured to extend along at least a portion of the upper.

13. The article of footwear of claim 1, wherein the A-shaped support frame is configured to extend upwards from the midsole towards the upper.

14. The article of footwear of claim 1, wherein the A-shaped support frame comprises one or more sloped or slanted sidewalls.

15. The article of footwear of claim 1, wherein the A-shaped support frame extends over both the medial side and the lateral side of the upper.

16. The article of footwear of claim 1, wherein the opening has a predetermined shape with a fixed geometry.

17. The article of footwear of claim 1, wherein the midsole comprises (i) a first recess for receiving the first leg of the A-shaped support frame, wherein the first recess extends along the firm durometer portion of the midsole and (ii) a second recess for receiving the second leg of the A-shaped support frame, wherein the second recess extends along the soft durometer portion of the midsole.

18. The article of footwear of claim 17, wherein the first leg is configured to extend along the firm durometer portion of the midsole, and wherein the second leg is configured to extend along the soft durometer portion of the midsole.

19. The article of footwear of claim 18, wherein the second recess is configured to extend along a portion of the firm durometer portion that is in contact with the soft durometer portion so that the second leg extends along or across both the firm durometer portion and the soft durometer portion.

20. The article of footwear of claim 1, wherein the A-shaped support frame is configured as a support frame with a predetermined shape and geometry.

* * * * *